United States Patent [19]

Petit

[11] Patent Number: 4,562,746

[45] Date of Patent: Jan. 7, 1986

[54] DYNAMOMETRIC TIGHTENING APPARATUS

[75] Inventor: Jean-Pierre Petit, Palaiseau, France

[73] Assignee: Facom, Morangis, France

[21] Appl. No.: 591,334

[22] Filed: Mar. 19, 1984

[30] Foreign Application Priority Data

Mar. 17, 1983 [FR] France ..... 83 04381

[51] Int. Cl.[4] ..... B25B 23/142

[52] U.S. Cl. ..... 73/862.23

[58] Field of Search ..... 73/862.21, 862.23, 862.26, 73/862.35

[56] References Cited

U.S. PATENT DOCUMENTS 3,619,612 11/1971 Belke ..... 73/862.35 X
4,006,629 2/1977 Barrett et al. .
4,244,434 1/1981 Wilson ..... 73/862.23 X

FOREIGN PATENT DOCUMENTS 2719937 11/1978 Fed. Rep. of Germany .
2843406 8/1980 Fed. Rep. of Germany .
3109166 1/1983 Fed. Rep. of Germany .
2261843 9/1975 France .
2359397 2/1978 France .
2432917 3/1980 France .
2444267 7/1980 France .
1576006 10/1980 United Kingdom .
0637737 12/1978 U.S.S.R. ..... 73/862.35

OTHER PUBLICATIONS

Electronics Letters, Dec. 31, 1970; vol. 6; No. 26; pp. 829, 864–866.

*Primary Examiner*—Charles A. Ruehl
*Attorney, Agent, or Firm*—Wenderoth, Lind & Ponack

[57] ABSTRACT

An apparatus displays the torque reached by a tightening tool on a case which is independent from the tool proper. For this purpose, the tool has diodes for transmitting infrared radiation, for example, while the case has diodes for receiving this radiation. In this way, the tool may be employed in any position while the case is placed in a visible region and displays the value of the torque applied to the part to be tightened.

16 Claims, 7 Drawing Figures

DYNAMOMETRIC TIGHTENING APPARATUS

BACKGROUND OF THE INVENTION

The present invention relates to tightening tools such as spanners, screwdrivers or the like by means of which parts may be tightened with a predetermined torque. These tools, which are termed dynamometric, have been known for a long time and attempts have been made to improve them so that they may be more practical in use by providing in the tool electronic display means, for example employing electroluminescent diodes, whereby the value of the torque in fact applied to the part to be tightened may be rendered directly readable.

Although they are more practical than fully-mechanical spanners, these tools still have certain drawbacks.

Firstly, the electronic circuit requires a power supply which, owing to the small amount of space available in the tool, cannot have a large size. Consequently, the autonomy of the tool from the point of view of the electric power supply is small. Secondly, as the display occurs behind a window in the holder of the tool, it is often hidden from view during its use in places which are difficult of access. This is particularly disadvantageous in the case of screwdrivers which are turned during tightening.

Thus, in the course of use, the display is only rarely easily visible to the user.

SUMMARY OF THE INVENTION

An object of the invention is to overcome these drawbacks.

The invention therefore provides a dynamometric tightening apparatus comprising a tightening tool such as a spanner, a screwdriver or the like, the tightening torque being detected and displayed so as to permit the verification of the torque exerted on the part to be tightened, wherein said tool comprises means transmitting a radiation carrying items of information concerning said torque and said tool is associated with means for receiving said radiation and independent of said tool and provided with means for remotely displaying the evolution of the torque during the progress of the tightening.

An apparatus arranged in this way permits the provision of a display device in a independent or autonomous case placed close to the working position and receiving the radiation carrying the information concerning the torque which is applied by means of the tool.

The case may be placed in a place which is easily visible and the display may have a large size since no restrictions as concerns size need to be imposed in the construction of the case. The latter may have a power supply in the form of batteries or may be connected to the mains supply. As concerns the tool, the transmitting means may be of small size which is quite compatible with the available space in the holder of the tool.

A better understanding of the invention will be had from the following description of an embodiment of the apparatus according to the invention.

BRIEF DESCRIPTION OF THE DRAWINGS

In the drawings, given merely by way of example.

DETAILED DESCRIPTION OF THE INVENTION

Figure 1:
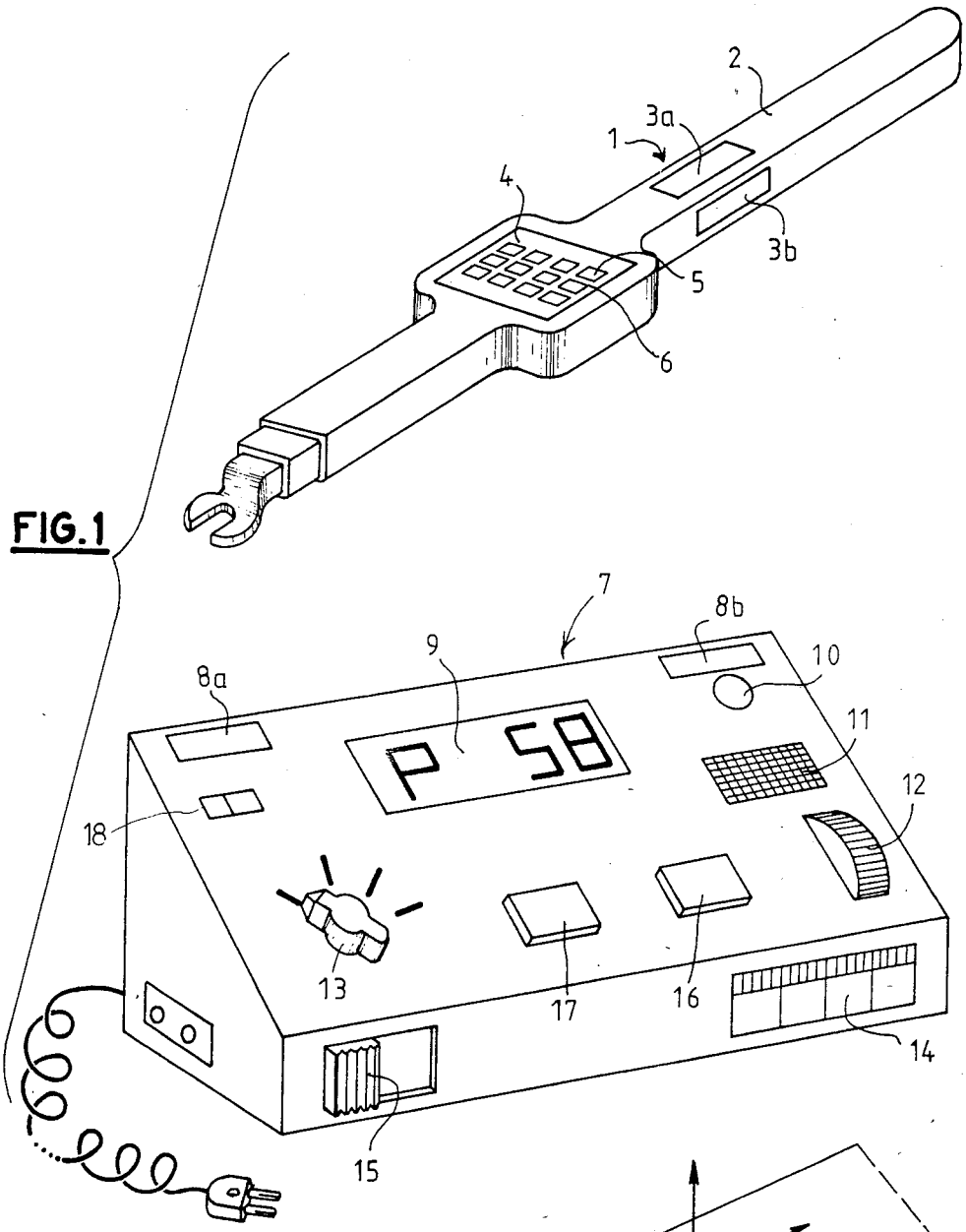
FIG. 1 is a diagrammatic perspective view of the apparatus according to the invention, the tool being a tightening spanner.

FIG. 1 shows a dynamometric tightening apparatus according to the invention.

This apparatus comprises a tool 1 whose mechanical part may be designed in accordance with the prior art, it being understood that its features are not part of the present invention. The holder or handle of this tool is of square or rectangular section and each lateral side receives, at least in the presently-described embodiment, transmitter diodes 3*a* and 3*b*. The holder is also provided with a keyboard 4 including selecting keys or buttons, a start-stop key 5 and a test key 6.

Figure 1A:
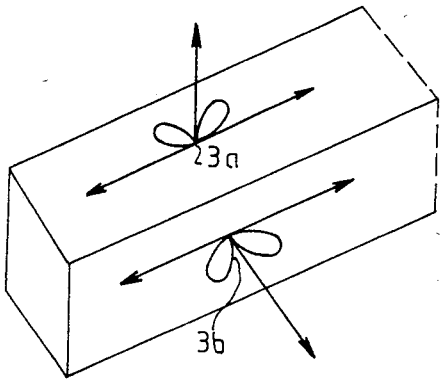
FIG. 1A shows diagrammatically the arrangement of the sources of radiation disposed in the transmitter.

FIG. 1A shows that the two diodes 3*a* and 3*b* which are respectively mounted in the four sides of the holder 2 are disposed at 90° to each other and transmit within a cone having an apex angle of 90°. The radiation pattern is therefore omnidirectional. It will be understood that other transmitter devices may be employed, such as a round tube or other device.

Preferably, the radiation employed is within the infrared range which has a wavelength which may be chosen for example between 200 and 1200 nm.

An electronic circuit and a supply source are disposed within the holder 2, but these elements have not been shown in FIG. 1.

The tool 1 is associated with a case 7 for receiving the radiation and displaying the torque values. This case encloses diodes receiving the radiation transmitted by the transmitter diodes 3*a* and 3*b*, these receiver diodes 8*a* and 8*b* being placed behind windows formed in the upper side of the apparatus. It is also possible to employ a single receiver diode which receives the radiation within a cone of about 120°.

In the presently-described and illustrated embodiment, the radiation has a wavelength within the infrared range.

The case 7 also has a display window 9 provided with a display device of any known type. Electroluminescent diodes or liquid crystals may be for example suitable. Also provided on this case are an electroluminescent diode 10 which lights up under certain conditions of operation of the apparatus, a loudspeaker 11 which produces a sound also under certain conditions of operation, a volume control knob 12 for the loudspeaker 11, a selector of set values 13 having for example four positions, a set 14 of set value locking buttons, a start-stop button 15, a test button 16, a programming button 17 and a selector 18 for changing the units displayed by the apparatus. The case 7 may moreover be provided with a mains supply means associated or not with a battery or the like which permits its autonomous operation.

Figure 2:
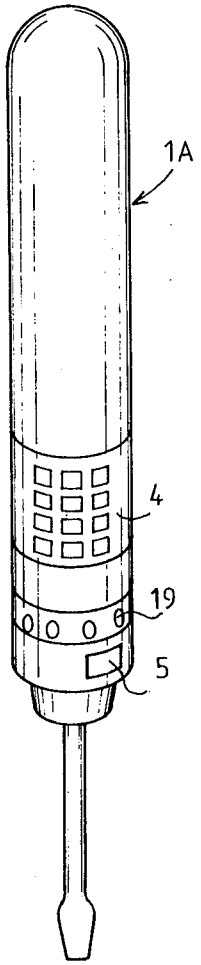
FIG. 2 is a perspective view of a tool which may be used in accordance with the invention and consists of a screwdriver.

FIG. 2 shows another tool 1A consisting of a screwdriver. The latter is provided with the same elements as the spanner shown in FIG. 1, except that the transmitter diodes are disposed in a transmission region 19 which permits a lateral radiation throughout 360° of the screwdriver.

Figure 3:
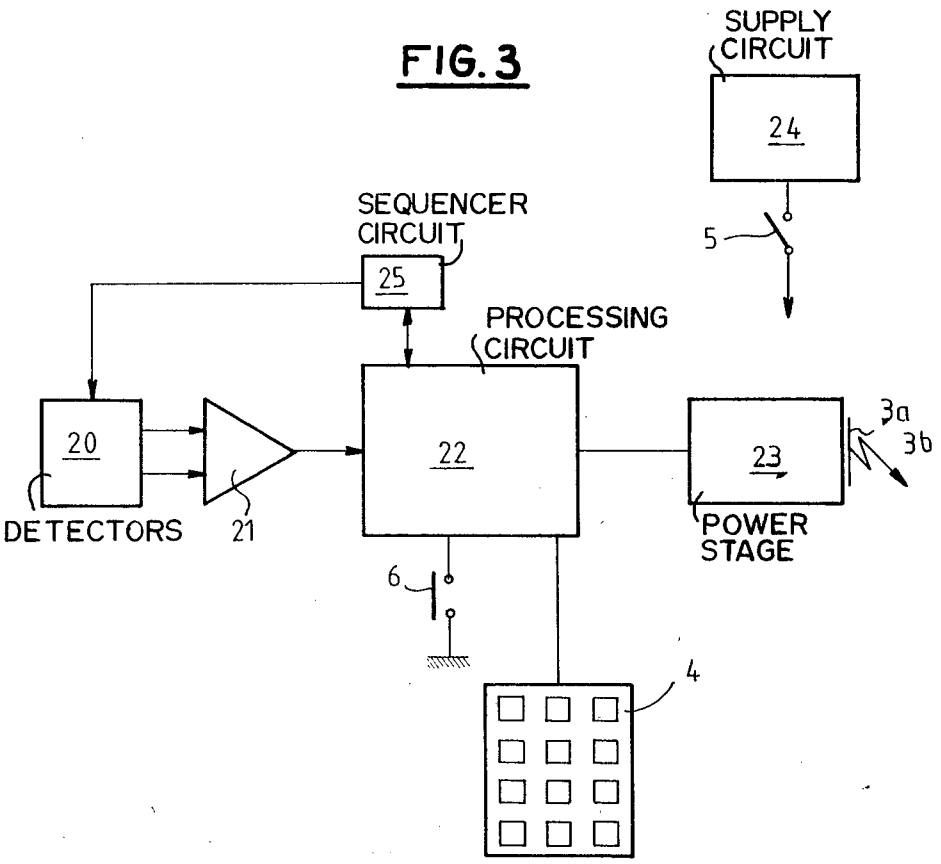
FIG. 3 is a simplified diagram of the transmitter disposed within the tool.

FIG. 3 shows a simplified circuit diagram of the transmitter placed in the tool 1. The latter has detectors 20 detecting the applied torque, the output signal of these detectors being transmitted to a differential amplifier 21. The latter is connected by its output to a processing circuit 22 which preferably includes a micro-processor. The processing circuit 22 performs the following functions. First, it converts the analog values delivered by the differential amplifier 21 into digital values which may be processed by the micro-processor. The latter encodes the digital values thus obtained in a series of pulses modulated in position. It will be seen that the message prepared in the transmitter is composed of packets of wave trains, each packet comprising a part identifying the tool in question and a digital part representing in particular the value of the torque applied by the tool to a part to be tightened. In the course of the stage for preparing a tightening operation, the part of the packet containing a digital value representing a torque may be a set value that the user can choose by means of his keyboard 4 and which is then transmitted, received and stored in the memory in the case 7.

The trains of pulses prepared in the processing circuit 22 are applied to a power stage 23 controlling, at the rhythm of the pulses received, the transmitter diodes 3*a* and 3*b* by an on-off signal.

It will be understood that the processing circuit is connected to the keyboard 4, to the test button 6 and to a supply circuit 24 through a start-stop button 5. The micro-processor is associated with a sequencer circuit 25 which ensures that the transmitter delivers an output signal only when this is strictly necessary. The mode of operation ensured by this sequencer will be explained hereinafter with reference to FIG. 5.

Preferably, the processing circuit 22 comprises means for wobbling the pulses. Indeed, if a plurality of apparatus according to the invention are employed in the same premises, it is important to avoid interference between the signals coming from the various transmitters and the fact of wobbling the signal permits limiting the interference between a plurality of transmissions.

Figure 4:
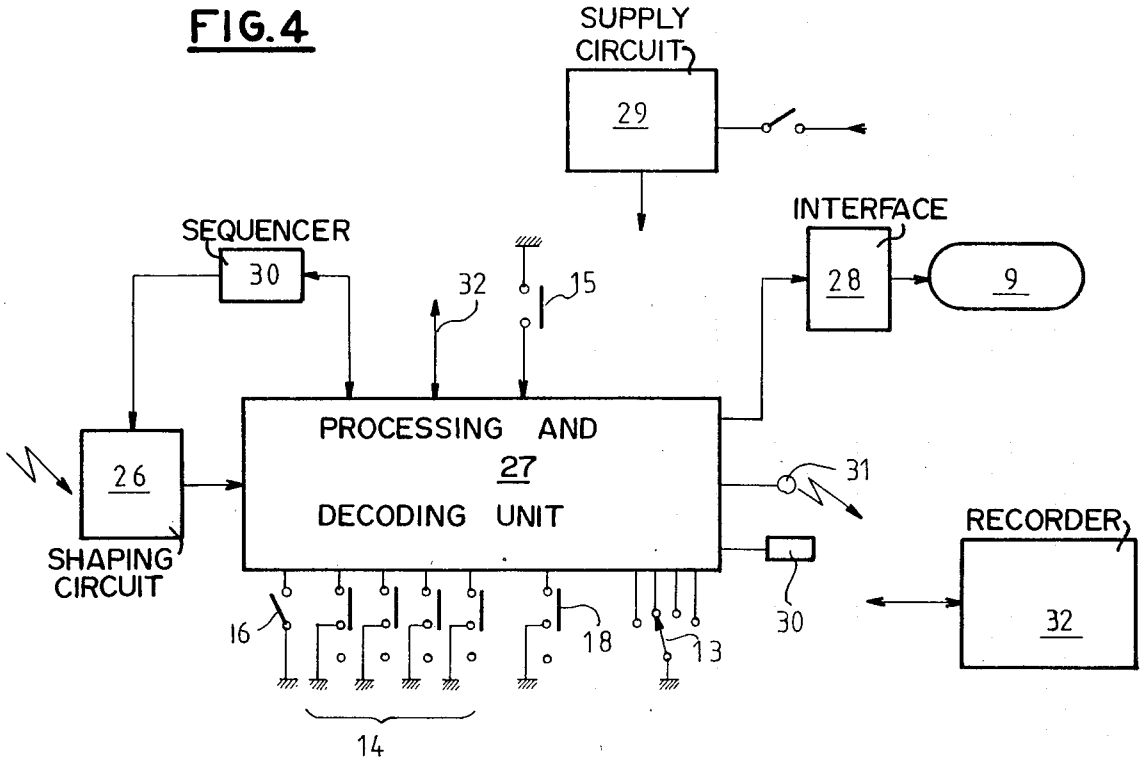
FIG. 4 is a simplified diagram of the receiver disposed within the case.

FIG. 4 shows a simplified diagram of the circuit disposed within the case 7. This case includes a circuit 26 for shaping the signals applied thereto through the diodes 8*a* and 8*b*. The shaped signals are transmitted to a processing and decoding unit 27 which is preferably in the form of a micro-processor. The latter is connected to the various elements controlled by the buttons listed hereinbefore in the course of the description of the case 7.

Provided between the processing unit 27 and the display circuit 9 is an interface 28 of conventional type adapted to convert the output signals of this unit into signals which can be displayed by the display elements such as those comprising electroluminescent diodes for example. The case 7 also includes a supply circuit 29 and a sequencer 30.

There may also be provided in the processing unit 27 a special output 31 for transmitting items of information received by the unit to a recording apparatus 32 disposed outside the apparatus. This recording apparatus may receive the items of information coming from a plurality of apparatus according to the invention placed in the same premises or workshop for example.

The apparatus according to the invention operates in the following manner. When a user desires to apply a given torque to a part to be tightened, he selects this torque by means of the keyboard 4 whereby the transmitter circuit shown in FIG. 3 transmits a train of pulses representing, on one hand, the identification of the tool and, on the other hand, the value of this torque. The latter, which is thereafter considered to be the set value, is received in the case 7 and stored in the processing unit 27. It is also stored in the processing and control circuit 22 of the transmitter. It will be understood that the set value may be displayed by the display device 9 on the case 7.

Figure 5:
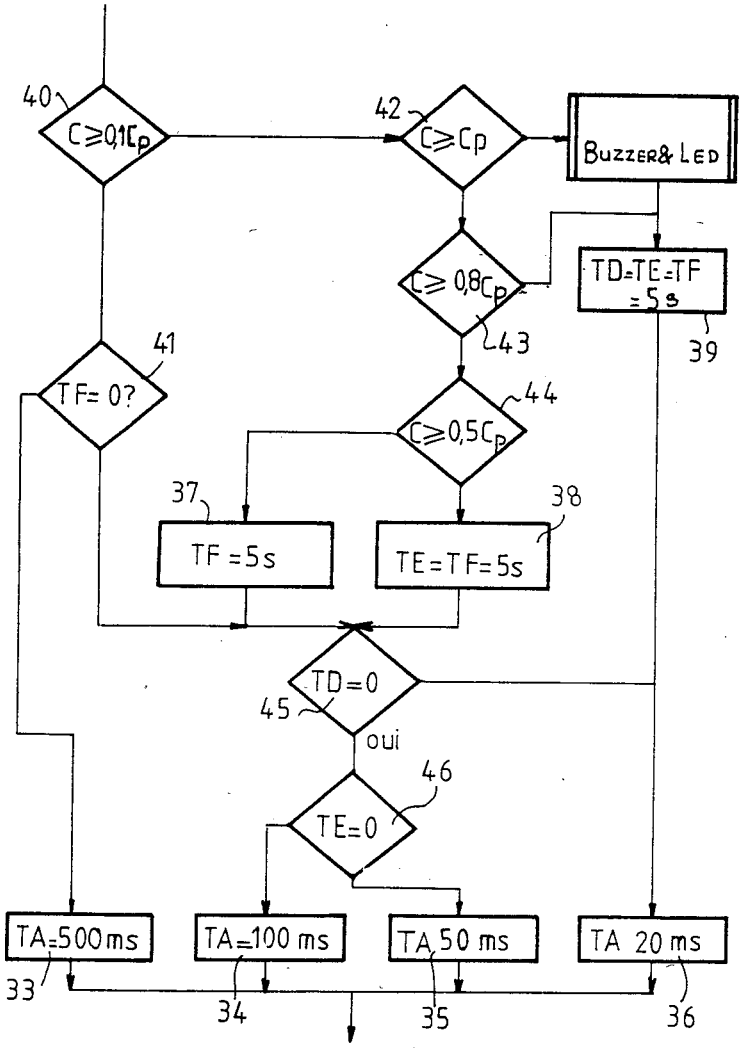
FIG. 5 is a block diagram of some of the functions performed in the transmitter.

A part of the program used in the processing circuit 22 is illustrated by the block diagram of FIG. 5, this program being effected when the user proceeds to tighten the part up to the set torque value which has just been stored in the memories of the tool 1 and the case 7.

In the course of the tightening operation, the program effects a plurality of tests so as to ascerain whether the torque applied corresponds to 10%, 50%, 80% and lastly 100% of the programmed set torque.

The micro-processor of the processing circuit 22 is capable of controlling the sequencer 25 in such manner that it locks the operation of the detectors 20 during predetermined periods of time, the length of these periods becoming shorter as the value of the tightening torque approaches the set torque value. Thus, at each of the percentages just mentioned, the sequencer 25 initiates measurements which are spaced with respect to time respectively by 500 ms, 100 ms, 50 ms and 20 ms, for example.

For this purpose, the processing circuit has four timing means which may be for example in the form of registers of the micro-processor of this circuit, these registers being counted down at the rythym of a time-base clock which is part of the circuit. Before being counted down, each of the registers contains a value which, bearing in mind the clock frequency, establishes one of the periods of time mentioned hereinbefore.

The block diagram of FIG. 5 also shows another feature of the invention which ensures that, when the user ceases his effort in the course of a tightening operation, the procedure does not immediately drop to an excessively low analysis rate, which might be dangerous for the element in the course of the tightening in the event that the user effects a sudden movement. In other words, when any one of the percentages mentioned hereinbefore is passed through for the first time, a period of time of a predetermined length (for example 5 seconds) is initiated and the program then arranges that, during this period, the succession of measurements is spaced apart with respect to time by an interval which corresponds to that established before the beginning of these 5 seconds.

In the micro-processor of the processing circuit 22 there is provided therefore other timing registers 37, 38 and 39 capable of establishing a predetermined period of time (for example 5 seconds) as a function of the frequency of the time-base clock.

The program is therefore carried out in the following manner according to the block diagram of FIG. 5. At the start of a tightening procedure, the torque applied is of course less than 10% of the set torque and, while the tightening torque remains below this value, a test is carried out at 40 so as to ascertain whether the tightening torque becomes equal to 10% of the set torque. If the result of the test is negative, the program effects at 41 a test TF=0?, so as to ascertain whether the timer 37 has reached the zero value. If the result of this test is positive, the program initiates the timing element 33 and the sequencer 25 is controlled in such manner that the measurements of torque are spaced apart the period of time determined by the timing element in question, ie. 500 ms in the example.

As soon as the value of the tightening torque exceeds 10% of the set value, the test at 40 receives a positive response and the program then passes onto a test 42 $C \geqq C_p$ so as to ascertain whether the tightening torque exceeds or is equal to the set torque. If the result of the test is negative, the program effects another test at 43 so as to ascertain whether the tightening torque exceeds or is equal to 80% of the set torque and if the result of this test is also negative, another test at 44 is effected so as to ascertain whether the tightening torque is equal to or exceeds 50% of the set torque. If the response to this test is also negative, the timer 37 is actuated during a period here fixed at 5 seconds. At the end of the period of time fixed by the timing element 37, two successive tests are effected at 45 and 46 so as to ascertain whether the timing elements TD, TE have reached the value 0. If the result of the first test is positive, the second is effected and if the second receives a positive response too, the sequencer 25 is actuated by means of the timing circuit 34 so as to establish a spacing between the measurements of 100 ms. If this last test at 46 receives a negative response, the same sequencer is actuated for spacing the measurements at 50 ms by means of the timing element 35. On the other hand, if the test at 45 receives a negative response, the timing element 36 is actuated so as to space the measurements only 20 ms apart. This signifies that the tightening torque exceeds 80% of the set torque. If the test at 43 receives a positive response, the three timing elements 37, 38, 39 are actuated for 5 seconds so as to maintain in any case an interval of time between the measurements of 20 ms.

When the response to the test effected at 42 is "yes", the torque applied is equal to the set torque and a signal is delivered which, through the transmission and reception diodes, and the circuits of the case 7, actuates the loudspeaker 11 and/or the signal diode 10.

Throughout this procedure, the transmitter diodes 3*a* and 3*b* of the tool transmit packets of data at intervals, fixed as a function of the torque applied by the timing elements 33 to 36, to the receiver diodes 8*a* and 8*b*, each packet being formed by an identification part and a numerical part representing the value of the torque applied. This value is permanently visible on the display 9.

Figure 6:
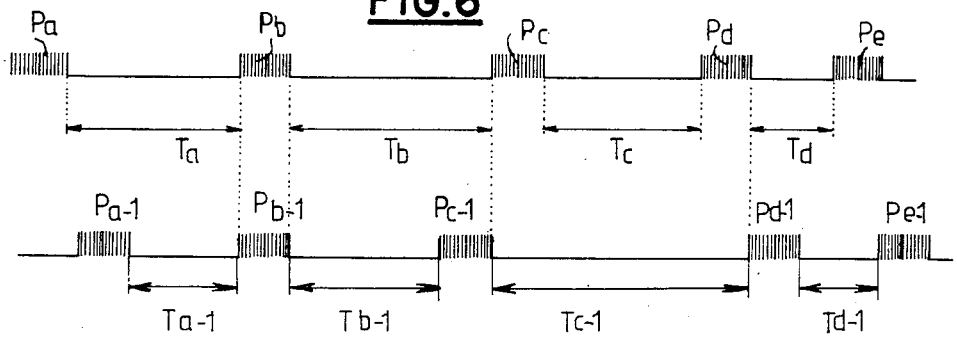
FIG. 6 is a time-base diagram of the transmissions of the tools of a plurality of apparatus according to the invention used on the same premises.

FIG. 6 shows a time-base diagram of the signals transmitted by two tools belonging to apparatus according to the invention which are placed in the same premises or close to each other so that their transmitted signals may be received by the cases 7 of the two apparatus.

In the course of a transmission, each tool transmits packets of pulses $P_a$, $P_b$, $P_c$ etc. . . and $P_{a-1}$, $P_{b-1}$, $P_{c-1}$, etc. . . each comprising an identification part ID and a numerical part NM representing the value of a set torque to be transmitted or of an applied torque measured at the considered instant.

The intervals between the packets of pulses $T_a$, $T_b$, $T_c$, etc. . . and $T_{a-1}$, $T_{b-1}$, $T_{c-1}$, et. . . are not constant but variable in a random manner for a period implying the transmission of 16 successive packets of pulses. Thus, the interval $T_a$ may last 5 ms, the interval $T_b$ 7 ms, the interval $T_c$ ϵ ms, etc. . . , the same intervals being again successively established after the transmission of 16 packets of pulses. As the distribution of the intervals is random for each tool, the probability of a simultaneous transmission of packets of pulses by two tools in proximity to each other is small, and in the event that such a simultaneous transmission nonetheless occurs, the processing units 37 of the cases 7 will interpret the signals received as being false. The coincidence of the two packets of pulses coming from two tools therefore cannot have an adverse effect on a true transmission of the items of the information since the following packets of pulses will have an extremely small probability of coincidence.

The pulses of each packet of pulses are modulated in position so as to transmit the number of the tool and the value of the considered torque : their duration may be, for example, 100 μs.

What is claimed is:

1. A dynamometric tightening apparatus comprising a tightening tool, such as a spanner, a screwdriver or the like, for exerting a torque on a part to be tightened, means for detecting and displaying the tightening torque so as to permit the ascertainment of the torque exerted on the part to be tightened, transmitting means for transmitting a radiation which carries items of information concerning said torque exerted, receiving means which are associated with said tool for receiving said radiation and are independent of said tool and are provided with said display means which are remote display means and display the evolution of the torque during the tightening.

2. An apparatus according to claim 1, wherein said transmitting means comprise diodes transmitting said radiation, said receiving means comprise at least one diode receiving said radiation, and said diodes operate within the infrared range.

3. An apparatus according to claim 2, wherein said diodes operate at a wavelength chosen in the range of 200 to 1200 nm.

4. An apparatus according to claim 2, wherein said tool is a spanner having a holder of rectangular section and said transmission diodes are disposed in the lateral sides of said holder.

5. An apparatus according to claim 4, wherein each side of the holder of the tool has two diodes so disposed as to transmit within a cone whose apex angle is 90°.

6. An apparatus according to claim 2, wherein said tool is a screwdriver having a substantially cylindrical holder and said transmitting diodes are disposed in the holder in such manner as to transmit in a plane within a 360° range.

7. An apparatus according to claim 2, wherein said tool comprises detectors for detecting the torque applied to the part to be tightened, a differential amplifier connected to said detectors and a control and processing circuit connected to said amplifier for converting analog signals delivered by the amplifier into digital signals and suitably shaping signals for transmission under the control of a sequencer circuit, the control and processing circuit having an output connected to said transmitting diodes through a power stage.

8. An apparatus according to claim 7, wherein a keyboard mounted in said tool is connected to said control and processing circuit for introducing a set torque to be reached in the course of the tightening of said part to be tightened.

9. An apparatus according to claim 7, wherein said receiving means comprise a receiver circuit for shaping signals received by the receiver diode or diodes, a processing unit connected to the receiver circuit and adapted to interpret the signals thus shaped for the purpose of their display, signalling means for delivering a perceptible signal when the torque applied by said tool reaches a previously-chosen set value, display means and a sequencing circuit for coordinating operations effected in said processing unit.

10. An apparatus according to claim 9, wherein a keyboard mounted in said tool is connected to said control and processing circuit for introducing a set torque to be reached in the course of the tightening of said part to be tightened, said processing unit comprises means for storing a plurality of set torques chosen by means of said tool, and means for successively selecting set torques thus stored for tightening said part which must be tightened with the selected set torque.

11. An apparatus according to claim 7, wherein said control and processing circuit and said sequencer are formed by a micro-processor.

12. A method effecting a dynamometric tightening of a part to be tightened by means of a tool such as a spanner, a screwdriver or the like, said method comprising generating and transmitting in said tool batches of pulses, each batch comprising a part representing the code of the considered tool and a part representing the torque applied to the part to be tightened, and comprising transmitting the successive batches of pulses at randomly determined intervals over a predetermined and repeated period of time.

13. A method according to claim 12, comprising transmitting said batches of pulses at a wobbled pulse frequency, the successive pulses being modulated in position for the transmission of a useful signal.

14. A method according to claim 12, comprising storing a set torque in a memory before the tightening of said part, comparing said set torque with the value of the torque effectively applied to said part to be tightened, and effecting successive measurements of said applied torque at successive intervals, the lengths of which intervals decrease as the value of the applied torque approaches the value of said set torque.

15. A method according to claim 14, wherein the intervals between the successive measurements of the applied torque are decreased each time a predetermined percentage of the value of said set torque is reached.

16. A method according to claim 15, further comprising delaying the decrease in the interval between two measurements during a predetermined period of time after the actual percentage of said set torque is reached.

* * * * *